United States Patent [19]

Diehl

[11] Patent Number: 4,661,215

[45] Date of Patent: Apr. 28, 1987

[54] PROCESS FOR THE PRODUCTION OF TIN-PLATED WIRES

[75] Inventor: Peter Diehl, Nurnberg, Fed. Rep. of Germany

[73] Assignee: Feindrahtwerk Adolf Edelhoff GmbH & Co., Fed. Rep. of Germany

[21] Appl. No.: 732,451

[22] Filed: May 9, 1985

[30] Foreign Application Priority Data

Jun. 1, 1984 [DE] Fed. Rep. of Germany ..... 3420514

[51] Int. Cl.[4] ..... C25D 7/06

[52] U.S. Cl. ..... 204/28; 204/38.4

[58] Field of Search ..... 204/28, 38.4, 207

[56] References Cited

U.S. PATENT DOCUMENTS

| | | | |
|---|---|---|---|
| 1,094,507 | 4/1914 | Wickwire | 204/38.4 |
| 1,331,888 | 2/1920 | Whitney | 204/38.4 |
| 2,093,238 | 9/1937 | Domm | 204/38.4 |
| 2,176,066 | 10/1939 | Domm | 204/38.4 |

*Primary Examiner*—T. M. Tufariello

*Attorney, Agent, or Firm*—Scully, Scott, Murphy & Presser

[57] ABSTRACT

A process for the production of tin-plated wires, in particular wires for electrical applications which are constituted of non-ferrous metals, for example, such as copper, having a diameter of 0.1 to 1.5 mm, and preferably of up to 1.0 mm, through the intermediary of a two-step tin-plating. The already finish-drawn wire is initially thinly hot tin-plated, thereafter cooled down, and finally galvanically tin-plated up to its finished coating thickness. Through the intermediary of this process, there can be uniformly tin-plated wires of the above-mentioned diameter, with a tin coating of 5 μm, wherein tolerances can be attained with a typical value of ±1.5 μm.

6 Claims, 2 Drawing Figures

PROCESS FOR THE PRODUCTION OF TIN-PLATED WIRES

BACKGROUND OF THE INVENTION

1. Field of the Invention

The present invention relates to a process for the production of tin-plated wires, in particular wires for electrical applications which are constituted of non-ferrous metals, for example, such as copper, having a diameter of 0.1 to 1.5 mm, and preferably of up to 1.0 mm, through the intermediary of a two-step tin-plating.

2. Discussion of the Prior Art

From the disclosure of German Patent No. 29 31 939 there is already currently known the utilization of a two-step tin-plating process, in which a copper wire is drawn down to a nominal size and soft-annealed prior to the first tin-plating step, thereafter galvanically tin-plated in two steps, with a drawing sequence being introduced therebetween, subsequently drawn at high speed to its final size and annealed for a short time in an annealing stage, and finally is intensively cooled. Hereby, the annealing is effected for such a short time that although the copper wire has been fully annealed, nevertheless the tin coating has only been partly fused or smelted thereon. This will preclude the formation of a diffusion layer or junction between the copper and the tin.

In this prior art process it has been ascertained as being disadvantageous that the copper wire must be tin-plated twice relatively heavily, so as to necessitate a relatively high consumption of tin, while furthermore, because of the short-time fusing or smelting on, there is encountered the danger that there will be adversely affected the concentricity of the tin coating on the wire, and finally, because of the absence of a diffusion layer between the copper and the tin, there is encountered the danger of the disassociation of the tin-plated wire during the later soldering.

In the tin-plating of wires utilized for electrical applications it is common to employ two processes; in effect, the hot tin-plating or the galvanic tin-plating, of which each one possesses specific advantages and also disadvantages. Through the employment of hot tin-plating there is achieved the greatest possible adherence of the tin coating to the wire material because of the formation of an intermetallic diffusion layer. In this instance, there is obtained a good resistance against disassociation. Concurrently, however, this process possesses the disadvantage in that the application of the tin coating on the wire is not effected concentrically, but there are obtained locations with a thinner and locations with a heavier tinplating. During the artificial aging of such wires, such as are required by current German Industry Standards for certain classes of tin-plating, there can be produced disassociable surfaces in the region of these thin locations through the growth of the diffusion layer, which can lead to the rejection of the wires. In order to avoid the foregoing, it is necessary to impart a relative heavy coating of tin.

The galvanic tin-plating possesses the advantage in that the growth of the tin coating or layer on the wire is effected concentrically, and the coating evidences a good degree of freedom from porosity. However, the disadvantage of the galvanic process resides in the absence of the intermetallic diffusion layer, so that there can readily occur the peeling or chipping off of the tin coating during the bending of the wire, or a disassociation of the substrate or core material during test soldering.

SUMMARY OF THE INVENTION

Accordingly, it is an object of the present invention, while avoiding the disadvantages encountered in the current state of the art, to provide wires through combining the advantages of hot tin-plating and of galvanic tin-plating processes, which possess a relatively thin tin coating or layer, which is uniform in its concentricity, which is nonporous and which affords due to the presence of an adequate diffusion layer, a good degree of adherence and thereby an excellent resistance against disassociation.

Inventively, the foregoing object is achieved in that the already finish-drawn wire is initially thinly hot tin-plated, thereafter cooled down, and finally galvanically tin-plated up to its finished coating thickness. Through the intermediary of this process, there can be uniformly tin-plated wires of the above-mentioned diameter, with a tin coating of 5 μm, wherein tolerances can be attained with a typical value of ±1.5 μm. These wires can be produced with an adequate diffusion layer because of the hot tin-plating process, while on the other hand, they also possess a good concentricity due to their uniform coating through the subsequent galvanic tin-plating. Because of the small tolerances which can be attained through the inventive process, there is obtained a low rejection rate, which in conjunction with the satisfactory rate of tin consumption due to the thinner coating thickness, leads to an extremely economical manufacturing process.

Pursuant to a further feature of the invention, it is contemplated that wire, which has been pretreated in a usual manner, is hot tin-plated under a temperature of between 400° C. and 240° C., preferably between 360° C. to 260° C. in a tin bath, tin-lead bath, or tin-nickel bath, at a dwelling period of less than 2 seconds, preferably below one second. In this manner can be achieved coating thicknesses of from 0.5 μm up to 1.5 μm, preferably 1.2 μm, in which the diffusion layer possesses a thickness of up to about 0.5 μm.

In a further aspect of the invention there is provided that the wire, which has been cooled down subsequent to the hot tin-plating and which has been pretreated in a usual manner, is galvanically tin-plated in a tin bath, or tin-lead or a tin-nickel bath, preferably a glossy lead-tin bath, with a coating thickness of about 3 to 10 μm, and preferably 4 μm.

In a preferred further embodiment of the invention, there is carried out the galvanic tin-plating of wires of a diameter of about 0.4 to 1.0 mm at a dwelling period in the tin-plating bath of 15 to 40 seconds, with a coating thickness of 4 μm up to a finished coating thickness of about 5 μm.

In a further modification of the invention there is additionally contemplated that the cooling down between the hot tin-plating and the galvanic tin-plating is carried out through the use of air, preferably in a countercurrent airflow.

Coming into consideration as wire materials for the tin-plating pursuant to the inventive process, are these constituted of non-ferrous metals such as, for example, copper, nickel, German silver, bronze, brass, inclusive their alloys; however, as well as iron. In addition to the utilization of round wire, it is possible to employ flat, rectangular, and contoured wire, as well as tapes or ribbons. Preferred as tin coatings are those which are constituted of pure tin or of lead-tin pursuant to the German Industry Standards (DIN).

Hereinbelow there are described two examples for the implementation of the inventive tin-plating process.

EXAMPLE 1

A copper wire, which has already been drawn down to its final dimension, travels at a speed of 80 m/min. through a decreasing bath having a bath length of 1 m. Thereafter, the wire travels through a flushing basin, as well as through a soldering flux basin wherein coating with flux is effected in the last-mentioned basin. The wire then travels over a reversing roller at an angle into a tin-lead bath which is heated to 260° C., having a length of 1.1 m. By means of a further reversing roller, there is effected the reversal of the wire into an upwardly vertical path of travel so as to exit the tin bath in the region of a drawing die. The wire then travels vertically upwardly through a cooling section of about 2.5 to 3 m in length, in which it is cooled down within a conduit in a countercurrent airflow to about room temperature.

By means of a reversing roller, the wire is conducted into an electrolytic degreasing bath having a length of about 1 m, thereafter rinsed with water, and subsequently pickled. Finally, for galvanic tin-plating, the wire travels into a glossy lead-tin bath, in which it travels over a series of reversing rollers over a distance of about 47 m. Its dwelling period in the galvanic tin bath, at a traveling speed of about 80 m/min., consists of about 35 secs.

After the galvanic tin-plating, the wire passes through a rinsing basin and a drying section before it is finally wound into a coil.

Assumed for the above-described example is a wire thickness of about 0.5 to 0.8 mm, wherein there is obtained in the hot tin-plating section a tin coating thickness of about 1.2 μm, with a diffusion layer thickness of about 0.5 μm.

In the following galvanic bath there is applied a further tin coating of about 4 μm to obtain a finished coating thickness of about 5 μm.

EXAMPLE 2

A wire having a diameter of about 0.5 to 0.8 mm travels through the first degreasing bath of 1 m in length at a speed of 120 m/min. The current density in the degreasing bath is hereby increased by about 30% relative to that in Example 1. The hot tin-plating bath consisting of tin-lead is at a temperature of 360° C., the length of the bath remains unchanged at 1.1 m. The reversal and the traveling through the drawing die is affected in the same manner as in Example 1, as well as the traveling through the cooling section.

The cooled wire travels at a speed of 120 m/min. into the galvanic bath which consists of glossy lead-tin, at a dwelling period of about 23 secs. The current intensity is raised by about 50% in comparison with that in Example 1. The rinsing, drying, and coiling is implemented in the same manner as in Example 1. Because of the given parameters there is obtained a tin plating having approximately the same coating thickness as that in Example 1.

BRIEF DESCRIPTION OF THE DRAWINGS

Reference may now be had to the following detailed description of a generally schematic representation of a two-step tin-plating installation for implementing the process pursuant to the invention, taken in conjunction with the accompanying drawings; in which.

DETAILED DESCRIPTION

Figure 1:
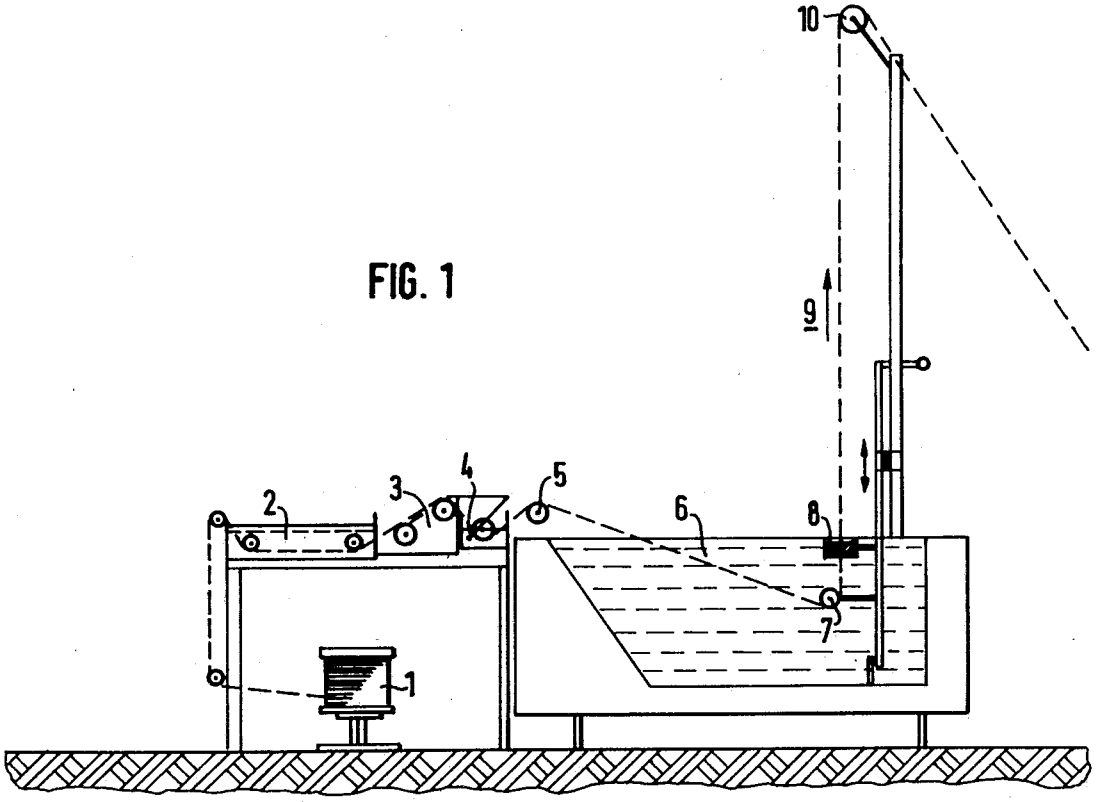
FIG. 1 illustrates the hot tin-plating section of the installation.
Figure 2:
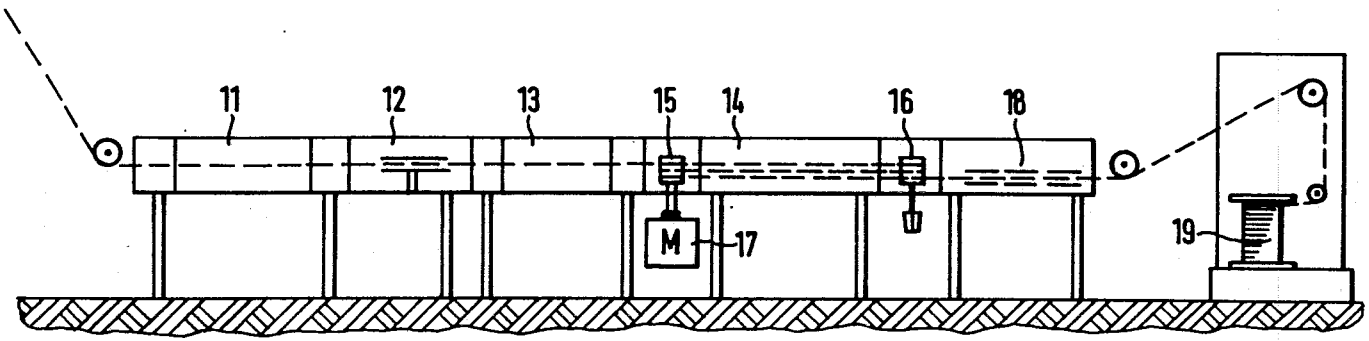
FIG. 2 illustrates the section of the installation employed for galvanic tin-plating.

In FIG. 1, a spooler is identified by the reference numeral 1, from which the finish-drawn blank wire is withdrawn, and conducted through a subsequently arranged degreasing bath 2. Downstream thereof, a clean-flushing basin 3, and a flux-coating basin 4 which is filled with soldering flux, are arranged in series. From the last-mentioned basin 4, the blank wire then travels over a reversing roller 5 at an angle into a tin bath 6 which is at a temperature of about 260° to 360° C. Arranged in the bath is a further reversing roller 7, over which the wire is deflected so as to travel vertically upwardly and leave the tin bath in the region of a drawing die 8. Thereafter, the wire travels upwardly in a vertical direction through a cooling section 9 which has a length of about 2.5 to 3 m. Hereby, the cooling section is formed of a conduit within which there travels the wire and is blown there against by a countercurrent flow of air. At a further reversing roller 10, the wire, which has been finished hot tin-plated, is deflected downwardly for effecting its entry into the galvanic tin-plating installation, as shown in FIG. 2 of the drawings.

The inlet to the galvanic tin-plating installation constitutes a degreasing bath 11, from which the wire subsequently passes into a rinsing unit 12, and thereafter into a pickling unit 13. Connected to the last-mentioned unit 13 is the electrolytic tin-plating bath 14 within which there are arranged a sequence of reversing rollers 15 and 16. In order to achieve a suitable dwelling period for the wire in the tin-plating bath at a small spatial expanse of the latter, the wire is conducted in a plurality of loops over the reversing rollers. In order to overcome the hereby produced mechanical resistance, the rollers 15 are driven by a motor 17. After leaving the electrolytic tin-plating section, the wire travels through a rinsing unit 18, and is finally coiled as finished wire onto a spooler 19 after passing through a drying installation (not shown).

What is claimed is:

1. In a process for the production of tin-plated wires for electrical applications, said wires having a diameter of about 0.1 to 1.5 mm, through the intermediary of a two-step tin-plating sequence; the process comprising:

thinly hot tin-plating a finish-drawn wire in a bath at a temperature between 240° C. and 400° C. for a dwelling period of less than two seconds to provide a thin coating;

subsequently cooling the wire; and finally galvanically tin-plating the wire to a finished coating thickness.

2. A process as claimed in claim 1, wherein the wire is thinly hot tin-plated at a tempertaure in the range of between 360° C. to 260° C., in a tin bath, tin-lead bath, or tin-nickel bath at a dwelling period of less than 1 sec.

3. A process as claimed in claim 2, comprising hot tin-plating the wire with a coating thickness of about 0.5 to 1.5 μm.

4. A process as claimed in claim 1, comprising galvanically tin-plating pretreated wire which has been cooled after effecting the hot tin-plating in a tin bath, tin-lead bath, tin-nickel bath, or glossy lead-tin bath, with a coating thickness of about 3 to 10 μm.

5. A process as claimed in claim 3, comprising galvanically tin-plating wires having a diameter of about 0.4 to 1.0 mm with a dwelling period in a tin-plating bath of 15 to 40 seconds with a coating thickness of about 4 μm to a finished coating thickness of about 5 μm.

6. A process as claimed in claim 1, comprising effecting cooling of the wire in air in a countercurrent airflow within a conduit.

* * * * *